US008472652B2

(12) United States Patent
Harma

(10) Patent No.: US 8,472,652 B2
(45) Date of Patent: Jun. 25, 2013

(54) AUDIO REPRODUCTION SYSTEM COMPRISING NARROW AND WIDE DIRECTIVITY LOUDSPEAKERS

(75) Inventor: Aki Sakari Harma, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 492 days.

(21) Appl. No.: 12/672,323

(22) PCT Filed: Aug. 11, 2008

(86) PCT No.: PCT/IB2008/053203

§ 371 (c)(1),
(2), (4) Date: Feb. 5, 2010

(87) PCT Pub. No.: WO2009/022278

PCT Pub. Date: Feb. 19, 2009

(65) Prior Publication Data

US 2011/0069850 A1 Mar. 24, 2011

(30) Foreign Application Priority Data

Aug. 14, 2007 (EP) ..... 07114285

(51) Int. Cl.
*H04R 5/02* (2006.01)

(52) U.S. Cl.
USPC ..... 381/307; 381/300; 381/302

(58) Field of Classification Search
USPC ..... 381/300, 302, 301, 303, 306–307
See application file for complete search history.

(56) References Cited

U.S. PATENT DOCUMENTS

| | | | | |
|---|---|---|---|---|
| 4,006,311 | A | 2/1977 | Carlsson | |
| 8,139,797 | B2 * | 3/2012 | Aylward et al. | 381/302 |
| 8,270,641 | B1 * | 9/2012 | Greenberg | 381/306 |
| 2004/0247140 | A1 * | 12/2004 | Norris et al. | 381/77 |
| 2005/0025318 | A1 * | 2/2005 | Sadaie et al. | 381/63 |
| 2006/0204022 | A1 * | 9/2006 | Hooley et al. | 381/117 |
| 2007/0036366 | A1 | 2/2007 | Konagai et al. | |
| 2007/0267062 | A1 * | 11/2007 | Rohwer et al. | 137/79 |
| 2008/0273722 | A1 * | 11/2008 | Aylward et al. | 381/302 |

FOREIGN PATENT DOCUMENTS

| | | | |
|---|---|---|---|
| EP | 1667488 | A1 | 6/2006 |
| EP | 1901582 | A1 | 3/2008 |
| JP | 02230898 | A | 9/1990 |
| JP | 06178379 | A | 6/1994 |
| WO | 02093773 | A1 | 11/2002 |

OTHER PUBLICATIONS

Komiyama et al: "A Loudspeaker-Array to Control Sound Image Distance"; Acoustical Science and Technology, vol. 24, Issue 5, pp. 242-249.

Schmitz: "Safir-Spatial Audio Framework for Instrumented Rooms"; Proceedings of IT104: Workshop on Invisible and Transparent Interfaces, 2004—7 Page Document.

* cited by examiner

*Primary Examiner* — Disler Paul

(57) ABSTRACT

An audio reproduction system includes an arrangement of audio speakers of a first kind having a first degree of directivity in combination with at least one audio speaker of a second kind having a second degree of directivity. In order to create a virtual sound source at a desired distance to a listener's position, the second degree of directivity is substantially larger than the first degree of directivity.

10 Claims, 2 Drawing Sheets

AUDIO REPRODUCTION SYSTEM COMPRISING NARROW AND WIDE DIRECTIVITY LOUDSPEAKERS

FIELD OF THE INVENTION

The invention relates to an audio reproduction system comprising an arrangement of loudspeakers.

Such conventional systems include several spatially positioned speakers and are for instance used as surround audio reproduction systems. Usually such a system has front speakers and rear speakers, wherein two or more speakers can be used for creating a phantom audio source located somewhere between the loudspeaker positions, such as somewhere between the front speakers.

In conventional audio reproduction systems the distance of the phantom source to a listener's position is always minimal the distance of the nearest loudspeaker to the listener's position. If such systems are used in speech communication systems, for instance distributed home telephony systems or telephony arrangements integrated into audio entertainment systems or the like, the perceived interpersonal distance has appeared to be a critical factor. Often, it is desired to create an illusion that the sound source is positioned closer to the listener than the position of the nearest loudspeaker. It has been determined that a natural distance between human beings in a conversation is typically smaller than 1.5 meters. The conventional surround audio reproduction systems are not able to create a virtual speaker at the natural distance to a listener being in an optimal listening position.

BACKGROUND OF THE INVENTION

An object of the invention is to provide an audio reproduction system which is able to create a virtual sound source at a desired distance to a listening position.

SUMMARY OF THE INVENTION

This object is achieved by the audio reproduction system according to the invention, which comprises an arrangement of loudspeakers of a first audio kind having a first degree of directivity in combination with at least one loudspeaker of a second audio kind having a second degree of directivity, wherein the second degree of directivity is substantially larger than the first degree of directivity.

In acoustics, directivity is a measure of the radiation pattern from a source indicating how much of the total energy from the source is radiating in a particular direction. The perceived distance of a sound source in a room environment depends fundamentally on the relative amplitudes of the direct sound, i.e. sound coming directly from the source, early reflections and reverberations. A characteristic for a sound source close to the point of observation, i.e. the listener's position, is that the amplitude of the direct sound is large compared to the level of the reflected sound energy.

In statistical room acoustics the amplitude of the sound at the point of observation is usually characterized by the following equation:

$$L_p = L_w + 10\log_{10}(Q/(4/\pi r^2) + 4/A)$$

Where the term $L_w$ is the power level of the source, the term r is the distance of the listener from the source and the term A is the absorption area of the room. The term Q represents the directivity index of the source such that Q=1 represent an omnidirectional source with a spherical directivity pattern, Q=2 represents a half-sphere, and generally a higher value of Q represents larger directionality. The two terms inside the logarithm in the above equation represent the direct sound and the reflected acoustic energy level in the room. From the first term inside the logarithm it is derivable that there is an exchange of the directivity index Q for the square of the distance r. That is, a highly directional source with large Q gives a similar contribution to the overall sound pressure level from a large distance than a less directional source closer to the point of observation. This also applies to the perceived distance of the sound source, whereby a highly directional source facing the listener seems closer than it actually is. The ratio between the two terms inside the logarithm in the equation yields a short distance for such a typical sound source in the room environment.

Several technologies for creating highly directional sound sources are known per se, for example, wave field synthesis using an array of loudspeakers, directional panel speakers or horn speakers. In practical experimentation with panel speakers it was found that the use of such a highly directional audio speaker gives a strong perceived illusion of having a sound source at a close range. However, the illusion was generally perceived as unnatural. This is mainly caused by the circumstance that the energy, associated with the two terms in the statistical acoustic description of the above equation, does match with the perception of a nearness of a sound source, but the room responses produced by the spatial and temporal properties of the directional sound field are unnatural. In other words, there is a mismatch between the perceived room effects related to natural sound sources in the environment and the room effects associated with the sound source rendered using the directional loudspeaker.

In the audio reproduction system according to the invention use is made of one or more directional, preferably high directional, audio speakers in combination with less directional audio speakers. Both kinds of speakers may be loudspeakers known per se. In an embodiment the wide or relatively wide directional audio speakers are surround audio speakers. These speakers are preferably used to modify the reverberant sound field by adding early reflections and diffuse reverberation to improve the naturalness of the perceived spatial audio experience.

It is noted that in this document the term "directional" indicates that an audio speaker, or in general a sound source, has the characteristic to radiate, during use, a sound beam having a narrow angle. Such a speaker has, therefore, a narrow or sharp directivity. In this context it is noted that the term "highly directional" relates to beams having very narrow angles. A speaker, or in general a sound source, producing such a kind of beam has therefore a highly directional character. There are several transducer technologies available for producing a highly directional sound field. An audio speaker having such a characteristic is for example a horn speaker, a panel speaker and an array units of loudspeakers driven in such a way that a desired pattern having a beam of narrow angle is generated. The term "less directional" indicates that an audio speaker, or in general a sound source, has the characteristic to radiate, during use, a sound beam having a wide angle, i.e. not a narrow angle. Such a speaker has, therefore, a wide directivity. Audio speakers having such a characteristic are for instance loudspeakers having cone or cone-like diaphragms. It is further noted that the terms "audio", "audio waves" and the like in this document relate to humanly audible sound. Audio waves are thus waves of audible sound, i.e. sound having frequencies being between approximately 20 and 20,000 Hz.

The invention also relates to a use of the audio reproduction system according to the invention. Preferably the system is located near a wall for creating an image source of a phantom sound source of the system.

The invention further relates to a telephony system, such as a distributed home telephony system or a telephony system integrated in an audio and/or video entertainment system, provided with the audio reproduction system according to the invention, and to an audio and/or video and/or data system provided with the audio reproduction system according to the invention.

Furthermore the invention relates to a method for reproducing sound. The method according to the invention comprises the steps of emitting audio waves from an arrangement of loudspeakers of a first degree of directivity and at the same time emitting audio waves from at least one loudspeaker of a second degree of directivity being substantially larger than the first degree of directivity for creating a virtual speaker location at a desired distance to a listener's position. This method is based on a same insight as discussed in the foregoing paragraphs and has similar advantages.

In a preferred variant of the method according to the invention audio speakers with a relatively wide directivity are used as loudspeakers of the first kind and an audio speaker with a highly narrow directivity is used as the at least one loudspeaker of the second kind.

Preferably, use is made of an image source created by reflection on a wall and audio signals are processed for composing audio sound out of audio waves emitted by the arrangement of loudspeakers of a first degree of directivity and audio waves emitted by the at least one loudspeaker of a second degree of directivity. Commercially available control hardware and software may be used for controlling audio signals. Signals may be delayed and/or attenuated in e.g. surround audio systems. A delay may be selected by elementary geometric analysis bases on the speed of sound propagation in a listener's ear and on the distance to the source. The amplitude relating to an image source may be chosen such that it reflects the attenuated sound in propagation in free-field conditions.

It is to be noted that US 2007/0036366 A1 discloses an audio characteristic correction system that is adapted to an audio surround system, in which a sound emitted from a directional speaker, particularly an array speaker, is reflected on a wall surface for creating a virtual speaker, which correction system is meant for correcting an audio signal input such, that the sound reflected on the wall surface has desired audio characteristics at the listener's position.

It is further noted that WO 02/093773 A1 discloses a non-conventional parametric sound system for creating multiple sound effects including a virtual sound source which is perceived by a listener as an original sound source. The system comprises an audio speaker in combination with a parametric speaker. During use, the audio speaker emits audio compression waves and the parametric speaker emits ultrasonic output oriented towards one or more reflective surfaces in the environment to create virtual sound sources to the directions from the listener where audio speakers are not positioned.

The system and method according to the invention are very suitable for use in distributed home telephony systems or telephony devices integrated into an audio entertainment system. The concept according to the invention can also be used successfully to create additional sound effects in surround audio playback, or in console or PC gaming applications.

With reference to the Claims it is noted that all possible combinations of features mentioned in the Claims are part of the invention.

These and other aspects of the invention are apparent from and will be elucidated with reference to the examples described hereinafter.

DETAILED DESCRIPTION

It is noted that the embodiments are schematically depicted. It is further noted that corresponding components have been given the same reference signs in the description of the exemplary embodiments.

Figure 1:
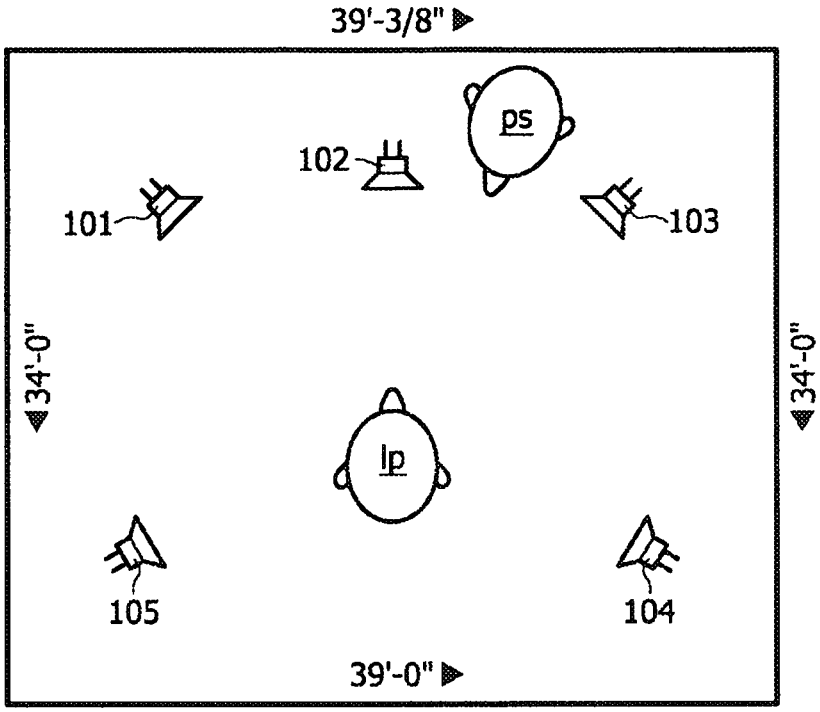
FIG. 1 is an example of a known audio reproducing system.

The known audio reproducing system depicted in FIG. 1 comprises a set of three front speakers 101, 102 and 103 and two rear speakers 104 and 105. The system is a surround audio playback system, wherein the speakers 101 to 105 are ordinary audio speakers. A listener's position lp is situated, as is customary, in the area bordered by the speaker. In speech communication a user being in the listener's position lp perceives in the given example a phantom source ps, between the front speakers 102 and 103, or in other word the voice of the speaking person is rendered in the given example in such a way that this person seems to be somewhere between the front speakers. In many cases the distance from the listener's position lp to the phantom source ps is larger than the natural distance between speaking persons.

Figure 2:
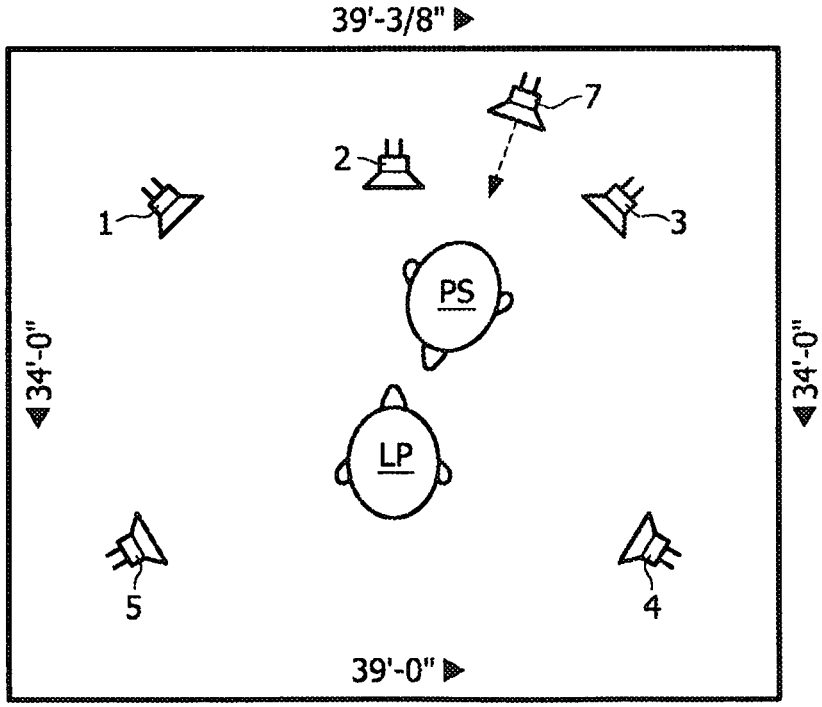
FIG. 2 is a first embodiment of the audio reproducing system according to the invention.

The preferred embodiment of the audio reproducing system according to the invention depicted in FIG. 2 comprises an arrangement of conventional surround audio speakers 1 to 5 having a relatively wide directivity and one audio speaker 7 having a highly narrow directivity. The audio speakers 1, 2 and 3 are front speakers, while the audio speakers 4 and 5 are rear speakers. The audio speaker 7 is located somewhere in the set of audio speakers 1 to 5, in this example somewhere between the audio speakers 2 and 3. The audio speaker 7 may be any audio speaker which is capable to produce a highly directional sound field, such as a flat panel speaker or a horn speaker. As usual, a listener's position LP is located in the area bordered and defined by the audio speakers 1 to 5. In speech communication a listener being in the listener's position LP perceives a phantom source PS in the area between the audio speakers 1 to 5 and the listener's position LP, in the given example from the front speakers 2 and 3, resulting in a shortened distance between the listener's position LP and the phantom source PS. This means that the voice of the speaking person is rendered in the given example in such a way that this person seems to be near to the listener. In this relatively easy way the distance from the listener's position LP to the phantom source PS can be adapted to a desired distance which will be usually the natural distance between speaking persons. The surround audio speakers 1 to 5 can be used to modify the reverberant sound field by adding early reflections and diffuse reverberation to improve the naturalness of the perceived spatial audio experience.

The directional speaker 7 can also be implemented using an array of loudspeakers such that a controlled array effect produces a directed sound beam to a desired direction. In such case, due to the linearity of the audio reproduction and acoustic systems, it is possible to use the elements of the same physical array as loudspeakers of the first degree of directivity. In the same way, when a loudspeaker array is used to create virtual surround audio reproduction, e.g. similarly to US 2007/0036366 A1, to the room environment, it is possible to use the same array simultaneously as the highly directional loudspeaker with the second degree of directivity. This can be achieved by adding driving signals producing the directional beam representing the loudspeaker of the second degree of directivity to loudspeaker signals driving the array to create the virtual surround audio reproduction.

Figure 3:
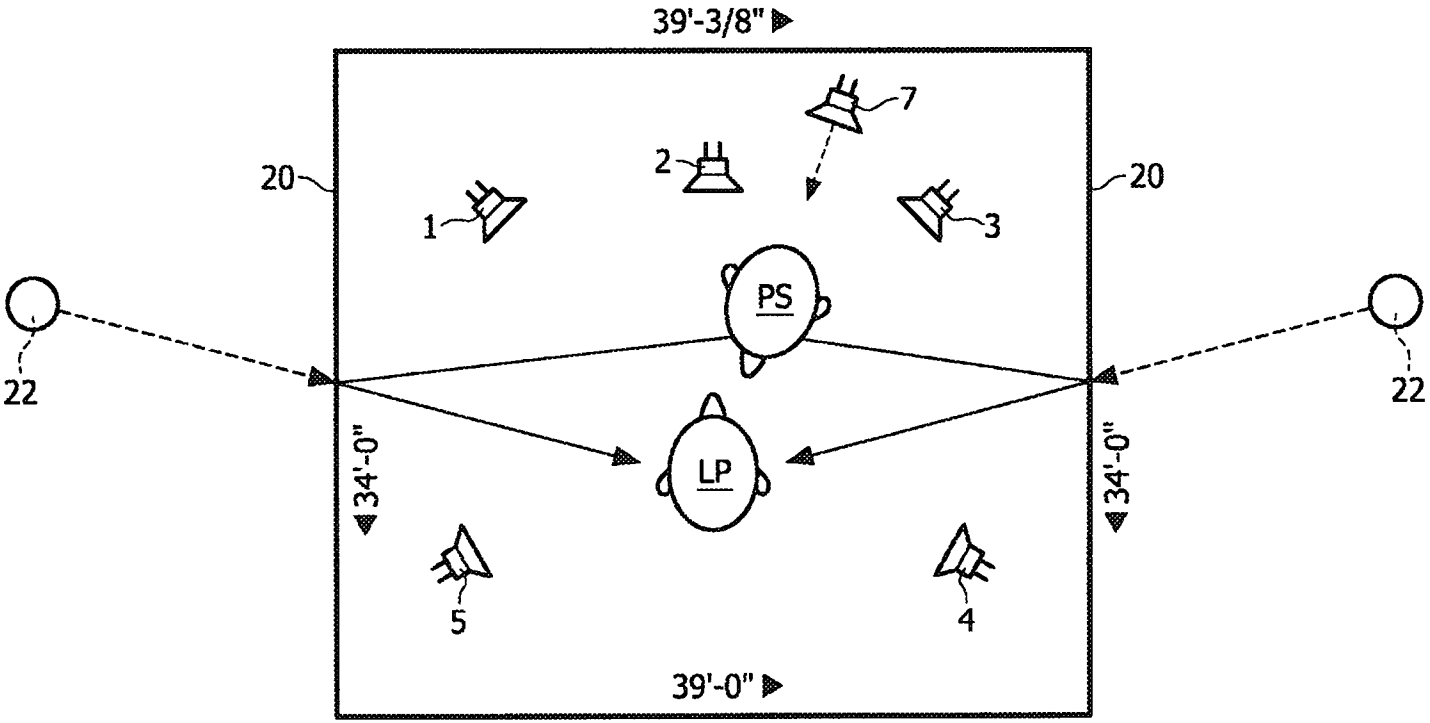
FIG. 3 is a second embodiment of the audio reproducing system according to the invention.

In the preferred embodiment depicted in FIG. 3 a similar arrangement is applied as in the embodiment of FIG. 2. Additionally, the combination of the playback from the highly directional audio speaker 7 and the traditional, i.e. here not highly directional, audio speakers 1 to 5 in the surround audio setup is based on a known concept of image source model. (Berkeley & Allen). Reflections from a wall 20 are represented by synthetic image sources 22 situated behind the wall. The sound representing the image sources can be rendered using the audio speakers 1 to 5 of the surround audio system by delaying and attenuating signals. The delay is selected by elementary geometric analysis based on the speed of sound propagation in the listener's ears and the distance to the sound source. The amplitude relating to the image sources 22 may be chosen such that they reflect the attenuation of sound in propagation in free-field conditions.

While the invention has been illustrated and described in detail in the drawings and foregoing description, illustration and description are to be considered illustrative or exemplary and not restrictive. The invention is not limited to the shown embodiments, for example, it is possible to apply more or less than the depicted number of audio speakers. It is particularly emphasized that more than one highly directional audio speaker can be used. There can be applied several highly directional audio speakers in the environment to produce sound sources in different directions. The presented embodiments can be scaled up to a multi-channel solutions.

Other variations to the disclosed examples can be understood and effected by the skilled person in practicing the claimed invention, from a study of the drawings, the description and the claims.

In the Claims and the description the word "comprising" does not exclude other elements, and the indefinite article "a" or "an" does not exclude a plurality. Any reference sign in the Claims should not be construed as limiting the scope.

The invention claimed is:

1. An audio reproduction system comprising an arrangement of loudspeakers of a first audio kind having a first degree of directivity in combination with at least one loudspeaker of a second audio kind having a second degree of directivity, wherein the second degree of directivity is larger than the first degree of directivity, and wherein the at least one loudspeaker is positioned at a loudspeaker location closer to a first loudspeaker of the arrangement of loudspeakers than to a listener to direct an audio signal to the listener such that a perceived distance perceived by the listener from the location of the listener to the loudspeaker location is shorter than an actual distance from the location of the listener to the loudspeaker location.

2. The audio reproduction system as claimed claim 1, where more than one loudspeaker of the second kind is provided.

3. The audio reproduction system as claimed in claim 1, wherein the system is a surround audio speaker system.

4. A use of the audio reproduction system as claimed in claim 1, wherein the system is located near a wall for creating an image source of a phantom sound source of the system.

5. A telephony system provided with the audio reproduction system as claimed in claim 1.

6. A system provided with the audio reproduction system as claimed in claim 1.

7. A method for reproducing sound comprising the acts of:

providing an arrangement of loudspeakers of a first degree of directivity and at least one loudspeaker of a second degree of directivity, wherein the second degree of directivity larger than the first degree of directivity;

emitting audio waves from the arrangement of loudspeakers and at the same time emitting audio waves from the at least one loudspeaker for creating a virtual speaker location at a desired distance to a position of a listener, wherein the at least one loudspeaker is positioned at a loudspeaker position closer to a first loudspeaker of the arrangement of loudspeakers than to the listener to direct an audio signal to the listener such that a perceived distance perceived by the listener from the loudspeaker position to the position of the listener is shorter than an actual distance from loudspeaker position to the position of the listener.

8. The method as claimed in claim 7, wherein the loudspeakers of the first kind comprise audio speakers and the at least one loudspeaker of the second kind comprise audio speaker.

9. The method as claimed in claim 7, wherein use is made of an image source created by reflection on a wall and audio signals are processed for composing audio sound out of audio waves emitted by the arrangement of loudspeakers of a first degree of directivity and audio waves emitted by the at least one loudspeaker of a second degree of directivity.

10. The method as claimed in claim 7, wherein an array of loudspeakers is driven in such a way that it creates simultaneously radiation patterns simulating the effect of a set of loudspeakers with the first degree of directivity and the at least one loudspeaker of the second degree of directivity.

* * * * *